US005768987A

United States Patent [19]

Saalasti

[11] Patent Number: 5,768,987

[45] Date of Patent: Jun. 23, 1998

[54] DEVICE FOR CLEARING THE SURFACE OF A DRUM PRESS

[75] Inventor: Timo Tapio Saalasti, Espoo, Finland

[73] Assignee: Finbark Oy, Espoo, Finland

[21] Appl. No.: 720,967

[22] Filed: Oct. 10, 1996

[30] Foreign Application Priority Data

Oct. 13, 1995 [FI] Finland ..... 954891

[51] Int. Cl.[6] ..... B30B 3/06

[52] U.S. Cl. ..... 100/157; 100/174; 425/365

[58] Field of Search ..... 100/121, 157, 100/174, 905; 425/365

[56] References Cited

U.S. PATENT DOCUMENTS

| | | | |
|---|---|---|---|
| 2,698,144 | 12/1954 | Reiffen . | |
| 2,795,184 | 6/1957 | Graham et al. | 100/121 |
| 3,342,124 | 9/1967 | Frykhult | 100/121 |
| 4,355,573 | 10/1982 | Berry . | |
| 5,095,815 | 3/1992 | Baumgartner . | |

FOREIGN PATENT DOCUMENTS

| | | | |
|---|---|---|---|
| 69207 | 12/1985 | Finland . | |
| 90442 | 11/1992 | Finland . | |
| 1046163 | 12/1953 | France . | |
| 682801 | 10/1939 | German Dem. Rep. . | |
| 49931 | 12/1889 | Germany . | |
| 1729431 | 9/1978 | Germany . | |
| 665498 | 1/1964 | Italy | 100/121 |

*Primary Examiner*—Stephen F. Gerrity
*Attorney, Agent, or Firm*—Birch, Stewart, Kolasch & Birch, LLP

[57] ABSTRACT

The invention relates to a drum press comprising a device for clearing the inner surface of the drum or the outer surface of the roll. The drum is usable for instance for squeezing moist bark so as to make it suitable as a fuel. The drum press has a removing device placed at a distance from the drum or roll surface for removing material. The removing device is placed at a distance from the surface and on the surface there is provided a clearing device attached thereto. The present invention markedly reduces wear on the drum.

10 Claims, 2 Drawing Sheets

DEVICE FOR CLEARING THE SURFACE OF A DRUM PRESS

BACKGROUND OF THE INVENTION

The present invention relates to a drum press comprising a device for clearing the inner surface of the drum or the outer surface of a roll. The drum is usable, for instance, for pressing moist bark so as to make it suitable as a fuel.

The drum press has a rotating drum and inside the drum is a parallel, eccentrically placed roll. As the drum rotates, the material to be handled is pressed between the roll and the drum. The drum mantle is usually perforated, so that water can be discharged from the material to be pressed through the drum mantle. The material to be pressed tends to adhere to the drum, and for this reason the drum press is usually also provided with a device for removing material adhering to the drum surface. The removing device is also needed for clearing the drum holes.

In some drum presses material is detached from the drum surface by means of a fast-moving discharge screw. The screw has teeth made of hard metal, which mill off the adhered material.

In the drum presses disclosed by FI patent specification 69207, material is removed from the drum by means of a firm scraper, which works off the material.

Neither of the clearing methods mentioned above is free of problems. The mill screw teeth are subjected to heavy wear and have to be replaced frequently. A firm scraper increases wear on the drum, because pressed material adheres to its front edge and abraids the drum. In addition, the scraper itself wears.

SUMMARY OF THE INVENTION

The main object of the present invention is to provide a drum press comprising a material removing means to clear the drum or roll surface, however, without the surface to be cleared or the removing means itself being subjected to damaging wear.

These objects can be achieved by placing the removing means at a distance from the surface and by attaching to the inner surface of the drum an appropriately designed clearing device for the removing means. The clearing device sweeps away the material from the removing means with each cycle. Any material connected to the roll can be cleared in a similar way.

The main effect of the present invention is the markedly reduced wear of the drum.

The arrangement is practicable in the clearing of a drum or a press roll.

The press in accordance with the invention can primarily be used for dehydrating material containing water. Pressing of bark, the purification of plant sludge, chemical pulp or peat are typical objects of application.

BRIEF DESCRIPTION OF THE DRAWINGS

A preferred embodiment of the invention will be described in greater detail below with reference to the accompanying drawings, wherein.

DETAILED DESCRIPTION OF THE INVENTION

The main components of the press are a rotating drum 1, a press roll 2 rotating inside the drum, and a scraper 3 for removing material from the drum surface. The drum has holes, through which liquid is discharged from the material to be pressed. The distance of the roll from the drum is preferably adjustable. The roll can also be hollow and perforated, whereby the liquid can be discharged also through the roll.

The drum press can be devised such that either the roll alone, or both the roll and the drum, or the drum alone are rotated.

Scraper 3 is a stationary blade placed in the longitudinal direction of the drum after the pressing point. The scraper is attached at its ends to the press body. Moreover, material deflectors 4 are attached to the scraper. For the material to be discharged from the drum, the roll and the drum are inclined, or optionally the deflectors are inclined in the output direction.

Techniques implemented in drum presses have been described e.g. in FI patent specifications 69207 and 90442.

Scraper 3 is mounted such that its front edge 3' does not touch the drum. The play is appropriately in the range of 5 to 10 mm. Practical tests have indicated that fibrous materials, such as bark, yield a pressed material mat so strong that, once its edge has risen above the scraper tip, the mat will proceed intact and will be readily detached from the drum 1. Should a particle get between the scraper and the drum, this has no practical impact.

Figure 1:
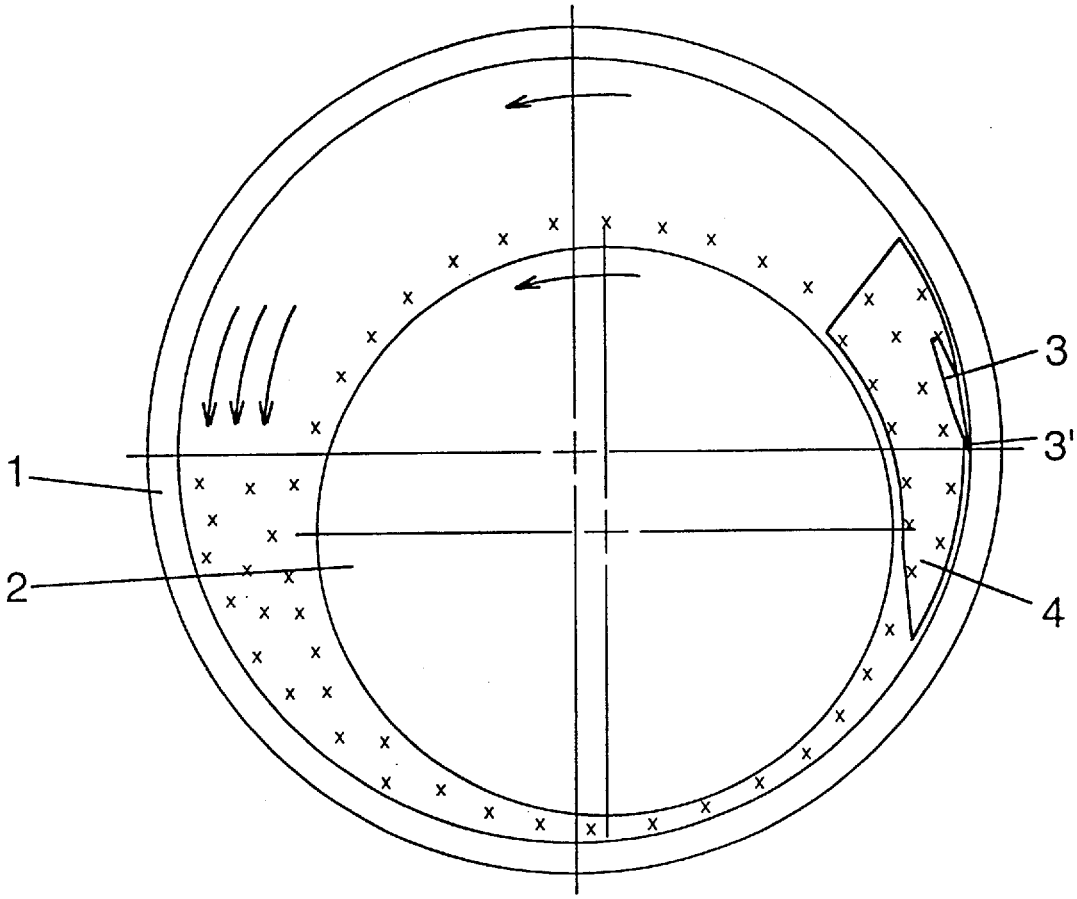
FIG. 1 shows an end view of the drum press.
Figure 2:
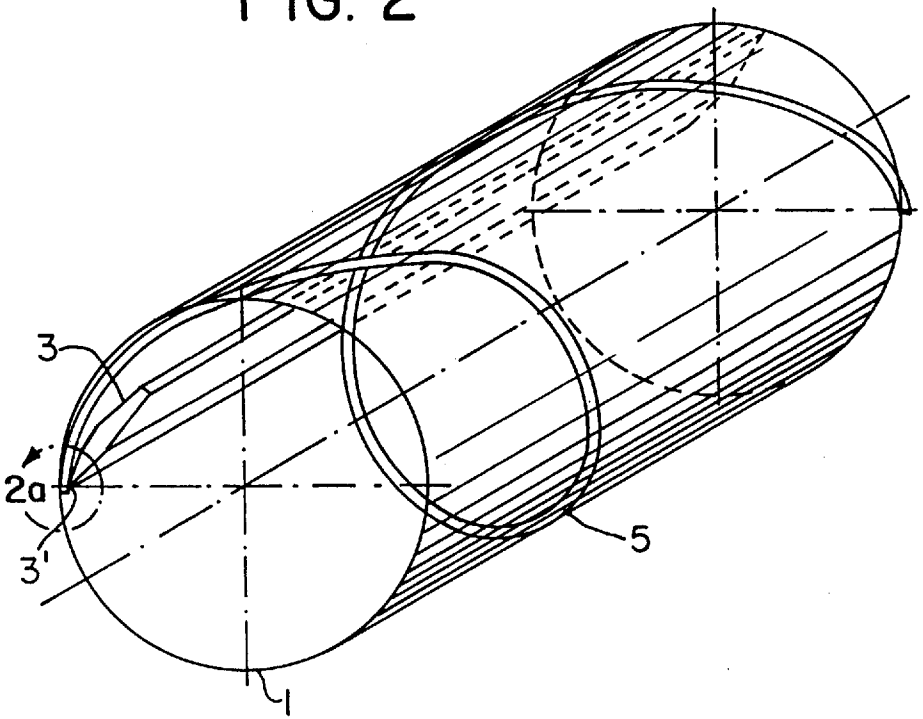
FIG. 2 is an oblique view of the other end of the same drum press of FIG. 1.
Figure 2A:
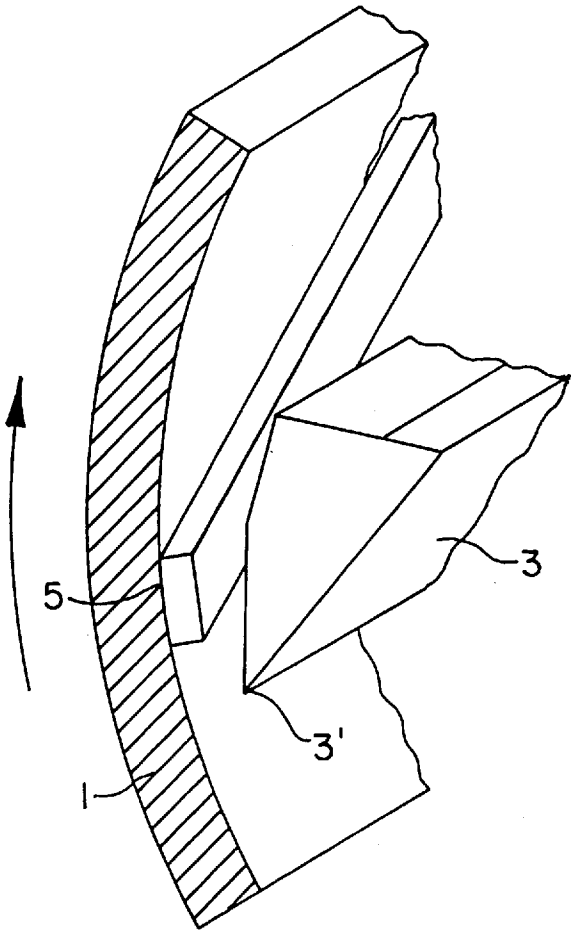
FIG. 2*a* shows an enlarged detail of FIG. 2.

Coarser material, such as branches and bark strips mixed with the bark, may gather between the scraper front edge 3'and the drum. To clear this gap, a ridge 5 with a height equal to the gap is provided on the drum surface (see FIG. 2*a*). The ridge surrounds the drum spirally. The ridge sweeps away material from the scraper in pulses, so that no material will abrade the drum and the scraper or which would tend to distort the scraper will gather between the scraper and the drum.

Preferably there is either a difference of angle between the scraper and the clearing means, or then the clearing means consists of stepwise successive elements. Otherwise a point of discontinuity will arise in the machine run as the clearing means and the scraper coincide.

Due to the clearing ridge, wear of the bark press drum is reduced even to less than fifty per cent. The power required to rotate the drum also decreases markedly, which particularly facilitates starting.

Reduced wear also allows the use of either an initially thinner drum or closer perforation, since a smaller wear margin is called for. Both of the designs promote dewatering.

Tests have shown that a corresponding arrangement clears the scraper efficiently also when short-fiber but sticky material is being handled.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A drum press which comprises:

a rotating drum having an inside surface, a rotating press roll mounted within the rotating drum, removing means fixedly mounted within the rotating drum to form a gap between the removing means and the inside surface of the rotating drum for removing material from the drum surface, and clearing means mounted to the inside surface of the rotating drum for clearing the gap between the removing means and the inside surface of the drum.

2. The drum press of claim 1, wherein the clearing means is positioned to pass between the inside surface of the drum and the removing means at least one time for every rotation of the drum.

3. The drum press of claim 1, wherein the removing means is a scraper.

4. The drum press of claim 1, wherein the clearing means is disposed at an angle relative to the removing means.

5. The drum press of claim 1, wherein the clearing means is a ridge extending from the inside surface of the drum and along said inside surface in a spiral configuration.

6. The drum press of claim 5, wherein the ridge has a height equal to the distance between the removing means and the inside surface of the drum.

7. The drum press of claim 1, wherein material deflectors are provided within the drum press for discharging the material removed from the drum surface.

8. The drum press of claim 7, wherein material deflectors are inclined to facilitate the discharge of the material from the drum.

9. The drum press of claim 1, wherein the drum is inclined to facilitate the discharge of the material from the drum.

10. A drum press which comprises:

a rotating drum having an inside surface, a rotating press roll mounted within the rotating drum, removing means fixedly mounted within the rotating drum to form a gap between the removing means and the inside surface of the rotating drum for removing material from the drum surface, and clearing means mounted to the inside surface of the rotating drum for sweeping away the material from the removing means clearing the gap between the removing means and the inside surface of the drum.

* * * * *